US005897671A

United States Patent [19]

Newman et al.

[11] Patent Number: 5,897,671

[45] Date of Patent: Apr. 27, 1999

[54] SYSTEM AND METHOD FOR WASHING MACHINE CYCLE IDENTIFICATION AND CHEMICAL DOSING IDENTIFICATION

[75] Inventors: Steven S. Newman; Michael A. Steed; Robert G. Cords, all of Santa Cruz, Calif.

[73] Assignee: Diversey Lever, Inc., Plymouth, Mich.

[21] Appl. No.: 08/965,812

[22] Filed: Nov. 7, 1997

[51] Int. Cl.[6] ..... D06F 39/02

[52] U.S. Cl. ..... 8/158; 68/12.02; 68/12.18; 222/1; 222/651

[58] Field of Search ..... 68/12.02, 12.18, 68/17 R; 8/158; 222/651, 1

[56] References Cited

U.S. PATENT DOCUMENTS

| | | | |
|---|---|---|---|
| 5,207,080 | 5/1993 | Reinhard | 68/12.18 |
| 5,392,618 | 2/1995 | Livingston et al. | 68/12.02 |
| 5,404,606 | 4/1995 | Mueller-Kirschbaum et al. | 68/12.18 X |

*Primary Examiner*—Philip R. Coe
*Attorney, Agent, or Firm*—Gary S. Williams; Flehr Hohbach Test Albritton & Herbert LLP

[57] ABSTRACT

A chemical dispensing system controller is used in conjunction with a mechanism for dispensing specified chemicals and a device that transmits trigger signals to the control system for requesting chemicals to be dispensed. The controller receives and accumulates sequences of the transmitted trigger signals. Each trigger signal sequence is preceded and followed by a period of time of predefined duration during which no trigger signals are received. At least some of the trigger signals in some of the trigger signal sequences are not received simultaneously. Also, the number of distinct chemical feed requests that can be communicated using the accumulated trigger signals exceeds the number of distinct trigger signals. The controller maps a first subset of the accumulated trigger signal sequences into chemical feed requests, each of which requests a quantity of a corresponding chemical. The controller enables the dispensing of chemicals in accordance with the chemical feed requests. A second subset of the accumulated trigger signal sequences are mapped into wash classification codes, each of which identifies a type of wash load to be washed using the dispensed chemicals. The number of distinct wash classification codes that can be communicated using the accumulated trigger signals exceeds the number of distinct trigger signals. When the control system uses a classification dependent feed arrangement, the chemical feed request corresponding to each received trigger signal sequence is determined based on both the current wash load type and the accumulated sequence of trigger signals.

16 Claims, 4 Drawing Sheets

SYSTEM AND METHOD FOR WASHING MACHINE CYCLE IDENTIFICATION AND CHEMICAL DOSING IDENTIFICATION

The present invention relates generally to the control systems for commercial and industrial laundry systems, and particularly to a system and method for using electrical trigger signals generated by programmable washing machines to identify the type of wash load being washed as well as to request the dispensing of chemicals.

BACKGROUND OF THE INVENTION

It is well known that it is desirable to customize the chemical doses delivered to commercial laundry machines in accordance with the type of wash load (e.g., shirts, towels, etc.) being laundered. When a microprocessor controlled chemical dispenser is used, the type of wash load can be communicated to the chemical dispenser by sending it signals representing a corresponding wash classification code.

Programmable washing machines generally have the ability to generate trigger signals, which are used to communicate feed requests to the chemical dispenser. When the chemical dispenser also receives a wash classification code for each load of laundry to be washed, the trigger signals can be interpreted differently for each different wash classification code, enabling the chemical dispenser to customize the chemical doses delivered to commercial laundry machines in accordance with the type of wash load.

Some programmable washing machines have only a few "triggers," which are signals used to communicate with the liquid chemical dispenser, and some can activate only one or two trigger signals at a time. These trigger generation limitations have made it impractical to use to trigger signals to communicate wash classification codes to chemical dispensers, because the number of distinct wash classifications required for many commercial and industrial washing machine systems exceeds the number of available distinct trigger signals.

To achieve chemical dosing and data logging based on wash classification, despite the trigger signal limitation in many programmable washing machines, some chemical dispenser manufacturers produce "Classification ID modules". These are attached at the washer, and the person operating the washer dials in the appropriate wash classification number at the start of a new load of wash. The dispenser receives signals corresponding to the number dialed in and performs custom chemical dosing and data logging in accordance with the wash classification dialed in by the washing machine operators.

The Classification ID modules add to the cost of buying and operating a commercial washing machine. Also, Classification ID modules create additional opportunities for operator error. If the operator does not enter the correct wash classification every time a new load gets washed, incorrect chemicals or quantities may be dispensed to the washing machine for those wash loads where the operator enters an incorrect wash classification.

The present invention produces the same results as the classification ID modules, but avoids the cost of buying and installing a "Classification ID module", and the possible operator errors in its use. More specifically, the present invention provides a method of overcoming the trigger signal limitation in programmable washing machines so as to allow a programmable washing machine to communicate to a chemical dispenser a sufficient range of wash classification values to cover all the wash classifications used in typical commercial laundries.

Another goal of the present invention is to enable a chemical dispenser to reliably sense the start and end of a washing machine cycle (i.e., the start and end of washing a load) for data logging purposes. Most or many washing machines do not have externally accessible Cycle Start and Cycle End signals that are suitable for sensing by a chemical dispenser or other computer controlled device. The present invention provides a method of using trigger signals in programmable washing machines for providing reliable Cycle Start and Cycle End signals to a chemical dispenser.

Yet another goal of the present invention is to provide a system with safeguards to avoid the dispensing of the wrong chemicals to a washing machine for a particular type of washing machine load. While it may be impossible to avoid the dispensing of wrong chemicals if the washing machine is improperly programmed, or if one of the trigger signals is defective, the present invention provides safeguards for avoiding wrong chemical dispensing due to power outages at the chemical dispenser and due to a washer operator starting a new cycle before a prior wash cycle has run to completion.

SUMMARY OF THE INVENTION

In summary, the present invention is a chemical dispensing system controller and a method for controlling chemical dispensing and for logging wash cycle starts and stops. The controller and method are used in conjunction with a mechanism for dispensing chemicals from a set of chemical supplies, and a device that transmits trigger signals to the controller for requesting chemicals to be dispensed from the chemical supplies. The controller receives and accumulates sequences of the transmitted trigger signals over defined periods of time, each trigger signal sequence consisting of one or more trigger signals. Each trigger signal sequence is preceded and followed by a period of time of predefined duration during which no trigger signals are received. At least some of the trigger signals in some of the trigger signal sequences are not received simultaneously. Also, the number of distinct chemical feed requests that can be communicated using the accumulated trigger signals exceeds the number of individual, distinct trigger signals.

The controller maps at least a first subset of the accumulated trigger signal sequences into chemical feed requests, each of which requests a quantity of a corresponding chemical to be dispensed. The controller enables the dispensing of chemicals in accordance with the chemical feed requests.

A second subset of the accumulated trigger signal sequences are mapped into wash classification codes, each of which identifies a type of wash load to be washed using the dispensed chemicals. The number of distinct wash classification codes that can be communicated using the accumulated trigger signals exceeds the number of distinct trigger signals.

When the control system uses a classification dependent feed arrangement, the chemical feed request corresponding to each received trigger signal sequence is determined based on both the current wash load type and the accumulated sequence of trigger signals.

At least one predefined accumulated trigger signal sequence is mapped into a wash cycle end code. The controller, when using a classification dependent feed arrangement, rejects trigger signal sequences that map to chemical feed requests when the last received wash cycle end code has not been followed by a wash classification code.

For systems using a classification dependent feed arrangement, the controller preferably includes a mechanism for detecting control system power outages and for determining their duration. The controller rejects a chemical feed request whenever a wash classification code has not been received since the last time a power outage was detected whose duration exceeded the predefined threshold.

BRIEF DESCRIPTION OF THE DRAWINGS

Additional objects and features of the invention will be more readily apparent from the following detailed description and appended claims when taken in conjunction with the drawings, in which:

DESCRIPTION OF THE PREFERRED EMBODIMENTS

Figure 1:
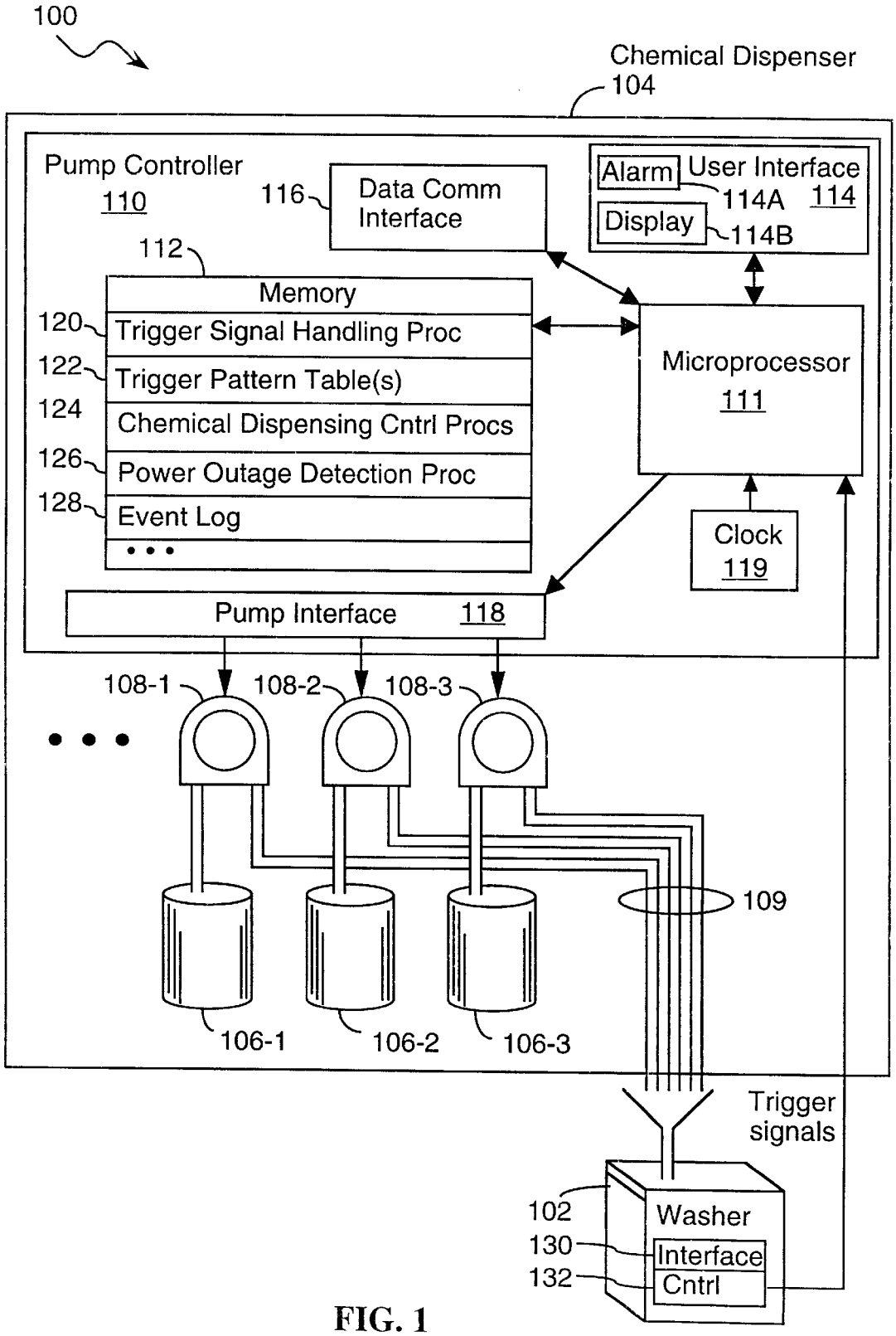
FIG. 1 is a block diagram of a laundry system having a programmable washing machine and a programmable chemical dispenser.

Referring to FIG. 1, there is shown a laundry system 100 having a programmable washing machine 102 and a liquid chemical dispenser 104. The washing machine sends electrical trigger signals or pulses to the liquid chemical dispenser 104 so as to indicate the beginning or end of a wash cycle and also to indicate a wash classification, which identifies the type of wash load to be washed.

For the purposes of the present invention, it is not particularly important how the washing machine determines the wash classification. It is sufficient to know that virtually all programmable washing machines have a user interface (not shown) by which the operator specifies the type of wash load being put in the washing machine, and that all such programmable washing machines can be programmed to transmit electrical trigger signals to the chemical dispenser at any point in the wash cycle. More specifically, the washing machine 102 can be programmed to transmit a specific sequence of trigger signals within a particular period of time, where the specific sequence of trigger signals indicates the wash classification.

Typically, programmable washers can activate at least four, and in some cases up to eight or more distinct trigger signals. However, many microprocessor controlled programmable washers can activate only one or two trigger signals at time. Activating different trigger signals causes the chemical dispenser to send different chemicals to the washer.

Typical System Configuration

The liquid chemical dispenser 104 preferably includes:

- a number of chemical supplies 106, typically ranging from four to ten in number;
- a corresponding number of pumps 108 for pumping chemicals from the supplies into the washing machine 102 via chemical feed lines 109; and
- a pump controller 110 for controlling the operation of the pumps 108, and thus for controlling the dispensing of chemicals into the washing machine 102.

The pump controller 110 preferably includes:

- a microprocessor 111 or other data processor for controlling the operation of the liquid chemical dispenser 104;
- memory 112, including non-volatile memory such as read-only memory (ROM), flash memory or magnetic disk storage, and random access memory (RAM);
- a user interface 114 for receiving user commands and displaying status information;
- a data communications interface 116, for communication with a host computer (not shown), such as for transmitting data logging information to a host computer;
- a pump interface 118 for sending signals that turn the pumps 108 on and off; and
- a battery powered clock circuit 119 for maintaining (i.e., continuously updating) a time value, even when the pump controller suffers a power outage.

The data processing procedures and data structures stored in memory 112 preferably include:

- a trigger signal handling procedure 120 for interpreting and processing trigger signals received from the washing machine 102;
- a trigger pattern table 122, which may be incorporated in the trigger signal handling procedure, for mapping trigger signal patterns into chemical feed request codes and wash classification codes;
- a chemical dispensing control procedure 124 for dispensing chemicals into the washing machine;
- a power outage detection procedure 126, which determines whenever a power outage of greater than N (e.g., 5) minutes has occurred, by comparing a time value maintained by software executed by the microprocessor 111 with a time value maintained by the battery powered clock circuit 119; and
- an event log 128 for storing data representing the trigger signal sequences received by the pump controller 110 and for indicting which of those sequences were considered to be errors.

The operator interface 114 preferably includes an audible alarm 114A for warning the laundry system operator of significant errors in the operation of the system, and may also include an operator viewable display 114B for displaying appropriate operator instructions (e.g., to restart the current wash load, or to call the system vendor) for responding to various alarm conditions.

When a classification dependent feed arrangement is being used, in which the chemical type and/or dosing quantity associated with each valid trigger signal pattern is dependent on the type of wash load being processed, a separate trigger pattern table 122 may be provided for each distinct, valid wash classification code.

The washing machine 102 has an operator interface 130 for indicating the type of wash load that is to be washed next. Preferably, the operator interface 130 includes either a dial, with one stop point for each different possible type of wash load, or a separate button for each different possible type of wash load. In chart controlled washing machines, the operator interface 130 includes a port for inserting and positioning a wash cycle control card or drum.

The washing machine's controller 132 sends electrical trigger signals to the chemical dispenser 104 in accordance with the wash load specified by the operator. As will be described below, in the preferred embodiment of the present invention trigger signals are sent at the beginning and end of each wash cycle to identify the wash cycle's start and stop points, and other trigger signals are sent by the washing machine's controller 132 to request the delivery of chemicals at various points in the wash cycle, as determined by the washing machine's controller. When the washing machine 102 is microprocessor controlled, the trigger signal transmissions are programmed into the control programs for each wash load type. When the washing machine 102 is chart controlled, the trigger signal transmissions are programmed into the control cards used for each wash load type.

The pump interface 118 receives signals from the microprocessor 111 and generates appropriate actuation signals for pumps 108. The pumps are coupled to respective ones of the liquid chemical containers 106, which hold liquid chemicals commonly used in laundry washing processes. Each pump draws a liquid chemical from a corresponding liquid chemical container through an intake conduit and forces it through an output conduit 119 into a chemical receptacle positioned at the washing machine 102.

In many commercial laundries, a single chemical dispenser 104 is connected to two or more washing machines 102. For simplicity, the operation of the present invention will be explained with respect to the interactions between a single washing machine 102 and a chemical dispenser 104. However, it should be understood that the present invention is applicable to, and in fact intended for use in laundry systems in which a single chemical dispenser 104 is connected to two or more washing machines 102.

In addition to using trigger signals for requesting the dispensing of chemicals, the present invention uses triggers signals to convey wash classification information to the chemical dispenser, indicating the type of load being washed. This allows the chemical dispenser to provide customized chemical dosing for different wash classifications as well as data logging. The number of different wash classifications used in most commercial installations is between ten and thirty.

In a first preferred embodiment, herein called the "simple trigger accumulation" embodiment, the present invention can handle up to thirty-one different wash classifications so long as the washing machine can generate at least six distinct trigger signals. In a second preferred embodiment, herein called the "time ordered trigger accumulation" embodiment, the present invention can handle up to thirty-one different wash classifications so long as the washing machine can generate at least five distinct trigger signals. In another, alternate embodiment (see the "Alternate Embodiments" section of this document, below), any washing machine with at least four distinct trigger signals can be used to handle an arbitrarily large number of wash classifications, essentially without limit.

If a washing machine could simultaneously and selectively activate five trigger signals, these could be interpreted as the bits of a five digit binary number, allowing a value between 1 and 31 to be sent to the chemical dispenser. However, this ability is limited to those washers that can simultaneously activate all five triggers.

One purpose of the present invention is to overcome the requirement that the washing machine be able to activate multiple trigger signals simultaneously. Many microprocessor controlled, programmable washing machines can activate only one or two trigger signals at a time.

The basic concept used by the present invention is to "accumulate triggers" from the washer over a defined period of time. In one embodiment, all trigger signals received by the chemical dispenser over the defined period of time are considered to have been received simultaneously. By accumulating trigger signals in this way, even those washing machines that can only activate one trigger at a time can convey wash load classification information to the chemical dispenser by sending a sequence of trigger signals within the defined time period. The trigger accumulation methodology can also be used to send chemical feed requests to the chemical dispenser.

Trigger Accumulation

In the preferred embodiments, the time period during which trigger signals are accumulated begins when any trigger signal is received after all trigger signals have been off for at least a predefined period of time DT1 (e.g., five seconds). Accumulation ends, after at least one trigger signal has been received, when all trigger signals have been off for at least the predefined period of time DT1. The guard times before and after a trigger accumulation period are five seconds in the preferred embodiments.

Trigger accumulation is used for processing all trigger signals, including trigger signals used for wash cycle start and end identification, trigger signals used for wash classification code identification, and trigger signals used to request chemical feeds. Some trigger signal "combinations" sent by the washer to the chemical dispenser will consist of a single trigger signal. Thus, for instance, trigger signal T2 might, when sent alone, be used to request the dispensing of a specific chemical. Alternately, the type of chemical requested by trigger signal T2 might vary in accordance with the type of wash load being washed. In all cases, a feed request signal will consist of one or more trigger signals transmitted by the washing machine followed by an interval of duration DT1 during which all trigger signals are off. The trigger signals that make up a single feed request must be separated from each other by less than the guard time (e.g., five seconds).

FIRST PREFERRED EMBODIMENT

Simple Trigger Accumulation

In the simplest preferred embodiment, trigger signals are accumulated during the defined time period. The order of the trigger signals during the defined time period is ignored. The logical OR of all the trigger signals active during the defined time period is used to define a binary value, with one bit for each trigger signal available in the system. In this embodiment, the trigger signal sequence T1 T2 is treated as being the same as the trigger signal sequent T2 T1.

An example of the mapping of trigger signal to wash classification codes in this embodiment is shown in Table 1.

TABLE 1

Example of Simple Mapping of Trigger Signals to Wash Classification Codes or Feed Request Codes

| Trigger Signals during Defined Time Period | | | Wash Classification Code or Feed Request Code |
|---|---|---|---|
| T1 | | | 1 |
| T2 | | | 2 |
| T1 | T2 | | 3 |
| T2 | T1 | | 3 |
| T3 | | | 4 |
| T3 | T1 | | 5 |
| T1 | T3 | | 5 |
| T3 | T2 | | 6 |
| T2 | T3 | | 6 |
| T3 | T2 | T1 | 7 |
| T3 | T1 | T2 | 7 |
| T1 | T2 | T3 | 7 |
| T1 | T3 | T2 | 7 |
| T2 | T1 | T3 | 7 |
| T2 | T3 | T1 | 7 |

The chemical dispenser's controller accumulates the trigger signals received during any defined time period. When the defined time period ends, the dispenser controller converts the set of received trigger signals into a wash classification code or a feed request code. In the preferred embodiments an additional trigger signal (e.g., T6) can be used to indicate whether a trigger signal sequence is a wash classification code or a feed request code. In other words, the trigger signal sequences shown in Table 1 are treated as wash classification code when they also include the T6 signal, and are treated as feed request codes when the trigger signal sequences do not include the T6 signal.

As explained above, in this "simple" embodiment, the trigger signal to code conversion is handled without regard to the order in which the trigger signals were received during the defined time period.

The simple embodiment is preferred for systems in which the number of available trigger signals is large enough to encode all the needed wash classification codes while using the simple trigger signal accumulation method. For instance, in a system in which the washing machine has at least six trigger signals, five of which are usable for sending a wash classification code, the number of different classification codes that can be encoded using the simple trigger accumulation method is equal to thirty-one ($2^5-1=31$). In most systems, thirty-one different wash classification codes is more than sufficient.

In a preferred implementation of the simple embodiment, each of the M potential accumulated trigger signals corresponds to one binary digit of an M-bit value. Each received trigger signal is mapped to a "1" value for the corresponding binary digit and each trigger signal not received during the accumulation period is mapped to a "0" value for its corresponding binary digit. The resulting binary value (also called a code) is then looked up in the trigger pattern table 122 to determine if the received trigger signal pattern represents a valid wash classification code or a valid feed request. If the binary code is invalid, the received signals are logged, but otherwise ignored. If the binary code is valid, the received signals are logged and the corresponding action is taken.

SECOND PREFERRED EMBODIMENT

Time Ordered Trigger Signal Accumulation

In a second, preferred embodiment, the order in which trigger signals are received by the chemical dispenser is taken into account when converting received trigger signals accumulated during a defined period to a wash classification or feed request code. As in the simple embodiment, the chemical dispenser's controller accumulates the trigger signals received during any defined time period. When the defined time period ends, the dispenser controller converts the set of received trigger signals into a wash classification code, or a feed request code, depending on when during a wash cycle the trigger signals are received.

For instance, Table 2 shows the mapping of time ordered trigger signals to wash classification codes for a washer that uses just three distinct trigger signals T1, T2 and T3 to indicate wash classification codes and feed codes. In this preferred embodiment, each trigger signal can only be used once as part of the signal sequence for identifying a wash code or chemical feed request, and thus there are fifteen (i.e., 3+3×2+3×2×1) distinct wash classification or feed request codes that can be communicated using three trigger signals, as shown in Table 2.

TABLE 2

Example of Mapping of Time Ordered Trigger Signals to Wash Classification or Feed Request Codes

| Sequence of Trigger Signals during Defined Time Period | | | Wash Classification Code or Feed Request Code |
|---|---|---|---|
| T1 | | | 1 |
| T2 | | | 2 |
| T3 | | | 3 |
| T1 | T2 | | 4 |
| T1 | T3 | | 5 |
| T2 | T1 | | 6 |
| T2 | T3 | | 7 |
| T3 | T1 | | 8 |
| T3 | T2 | | 9 |
| T1 | T2 | T3 | 10 |
| T1 | T3 | T2 | 11 |
| T2 | T1 | T3 | 12 |
| T2 | T3 | T1 | 13 |
| T3 | T1 | T2 | 14 |
| T3 | T2 | T1 | 15 |

As indicated by Table 2, the mapping of the trigger signals depends on the order in which the signals are received. If the prohibition on using the same trigger signal more than once during the defined time period is eliminated, the number of wash classification codes and feed codes that can be encoded using three trigger signals is essentially infinite.

In a system in which the washing machine has five trigger signals that are usable for sending a wash classification code, the number of different wash classification codes that can be encoded using the time ordered trigger accumulation method is equal to three hundred twenty-five (5+5×4+5×4×3+5×4×3×2×2=325). If the washing machine has four trigger signals that are usable for sending a wash classification code, the number of different wash classification codes that can be encoded using the time ordered trigger accumulation method is equal to sixty-four.

In most implementations, the number of distinct chemicals dispensed by the dispenser ranges from five to ten or so. Therefore, a sequence of two trigger signals will almost always be sufficient to identify the chemical being requested by the washing machine. For instance, in a system with six distinct trigger signals (T1to T6), with one (T6) being reserved to indicate the start and end of each wash cycle (as will be described in more detail below), five trigger signals are available for chemical feed requests. Using the simple trigger accumulation method, the number of feed request codes that can be represented with single trigger signal sequences and two trigger signal sequences is fifteen: five "single trigger signal sequences" and ten "two trigger signal sequences." Alternately, using the "binary coding approach", four trigger signals can be used to represent up to sixteen distinct feed request codes. Using the time ordered trigger accumulation method, the number of feed request codes that can be represented with single trigger signal sequences and two trigger signal sequences is twenty-five: five "single trigger signal sequences" and twenty "two trigger signal sequences."

Marking Wash Cycle Start and End, and Wrong Chemical Feed Prevention

Except where otherwise noted, the following portion of the explanation of the present invention is equally applicable to embodiments using simple trigger accumulation and embodiments using time ordered trigger accumulation.

Figure 2:
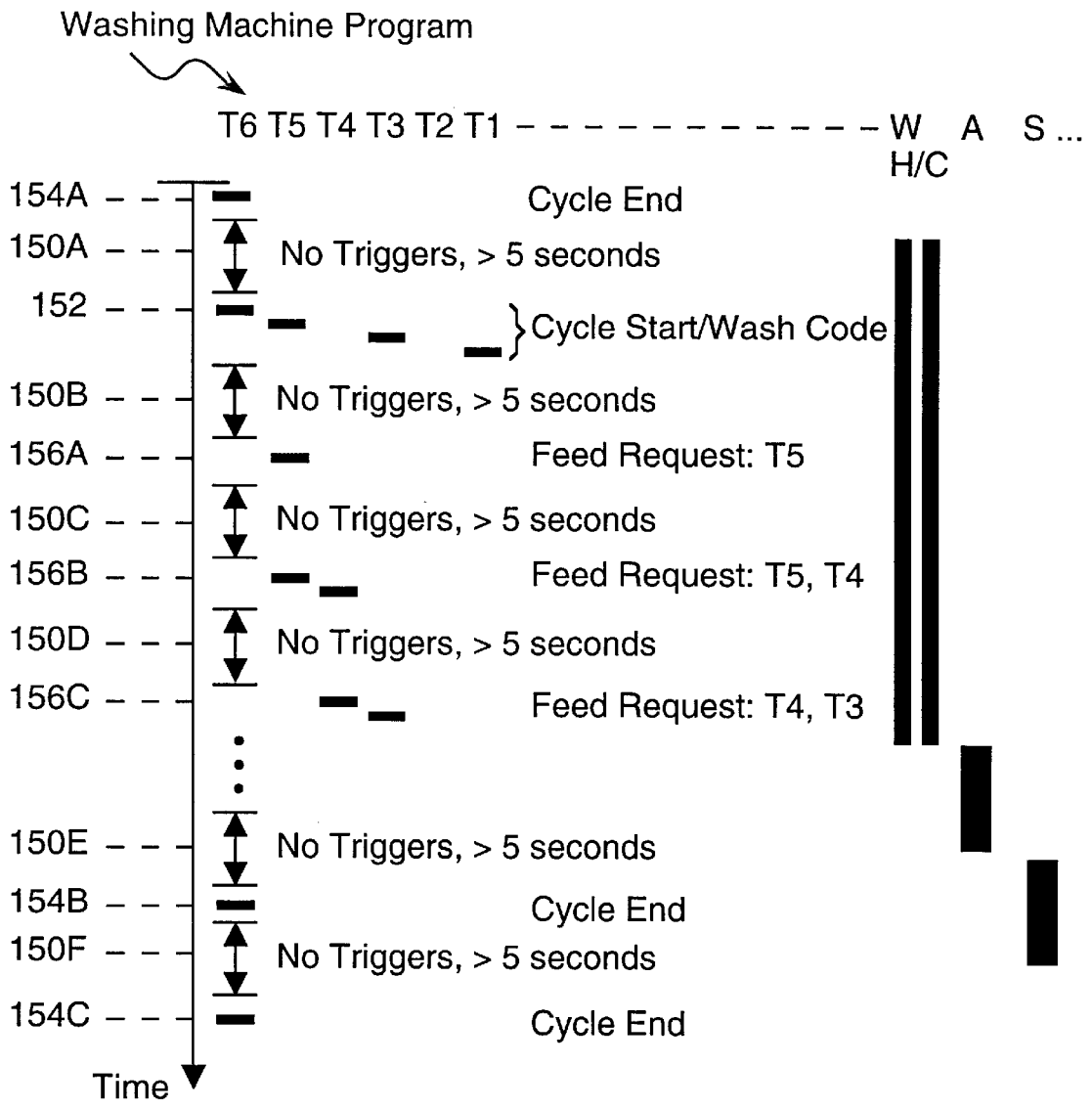
FIG. 2 is a time-line view of typical control and trigger signals generated by a washing machine's controller.

FIG. 2 shows a typical control signal and trigger signal sequence generated by a washing machine for a particular type of wash load, in accordance with the preferred embodiment. The various features of the trigger signal sequence will be explained next. Separate columns of FIG. 2 are used to show when trigger signals are generated and when wash control signals are generated. Six trigger signals are indicated by columns denoted as T6 through T1. The wash control signals shown are W H and W C (for enabling hot and cold water to be "dispensed" into the washing machine), A for enabling agitation of the wash load, and S for enabling spinning of the wash load and draining of water from the washing machine. The wash control and trigger signals shown in FIG. 2 are only examples, and may vary considerably from one implementation of the invention to another.

In FIG. 2 the five second "no trigger signal intervals" between trigger signal combinations are denoted by reference numbers 150A–150F, and collectively by reference number 150. The trigger signal combinations used to identify the start and end of a wash cycle are denoted by reference numbers 152 and 154 (i.e., 154A, 154B and 154C), respectively. Finally, trigger signal combinations used to request chemical feeds are denoted by reference number 156 (i.e., 156A, 156B, et seq.). Sometimes, trigger signal combinations (including combinations consisting of a single trigger signal) are called "codes".

For the purposes of explaining this feature of the invention, we will assume that the washing machine has the ability to transmit six distinct trigger signals, T6 to T1. However, it should be understood that the present invention can be used in any computer or microprocessor controlled chemical dispensing system having at least one programmable washing machine with at least four distinct trigger signals.

The washing machine does not need to be able to send more than one trigger signal at a time, but must be able to send a sequence of trigger signals with less than five second gaps between trigger signal transmissions.

To prevent the chemical dispenser from confusing wash classification codes with feed request codes, both of which are transmitted by the washing machine using trigger signals, in the preferred embodiments a set of special trigger signal sequences (called Control Codes) are used to mark the beginning and end of each wash cycle.

There are three types of "control code" information that need to be conveyed to the chemical dispenser for every wash cycle: the wash cycle start, the wash classification code, and the wash cycle end. To reduce the number of control codes, in the preferred embodiment the Cycle Start control code and the wash classification code are combined into a single control code.

More specifically, one trigger signal is "set aside" and used only for control codes. For example, trigger signal T6 could be used as the control code signal. In the preferred embodiments, the following signal encoding scheme is used:

| Signal Pattern | Description |
|---|---|
| T6 plus any sequence of T1–T5 | Cycle Start/ID code. The Wash Classification Code is indicated by the sequence of T1–T5 signals. |
| T6 and no other signals | Cycle End code. |
| Any sequence of T1–T5 (no T6) | Chemical Feed Request, with the chemical being identified by the sequence of T1–T5 signals. |

The normal sequence of trigger signal based codes sent by a washing machine to a chemical dispenser is a Cycle Start/ID code, followed by any number of Feed Request codes, followed by any number of Cycle End codes. Sequences that don't fit this pattern are called "out of synch" sequences that require analysis and error handling by the chemical dispenser. Also, sequences that appear "normal" might require error handling if the chemical dispenser loses power, and therefore might have missed trigger signals from the washing machine.

The error conditions that can occur and the appropriate responses depend on both the type of wash/dispenser feed arrangement being used, as well as on the type of washer. The two types of washer/dispenser feed arrangement are herein called Classification Independent Feed Arrangements and Classification Dependent Feed Arrangements Classification Independent Feed Arrangements. In systems using classification independent feed arrangements, each distinct chemical feed request code always results in a particular amount of a particular chemical (or a particular combination of chemicals) being dispensed, regardless of the wash classification code for the current wash load. In these types of systems, the wash classification code is used solely for data logging and does not affect the type or quantity of chemical dispensed.

The errors detectable by the chemical dispenser for Classification Independent Feed systems only result in inaccurate data logging and do not result in the wrong chemicals or quantities being injected into a washing machine, and therefore error handling in such systems is restricted to simply noting and reporting the error, but otherwise continuing to honor every chemical feed request.

Classification Dependent Feed Arrangements. In systems using classification dependent feed arrangements, the meaning of each chemical feed request code can depend on the type of wash load in the washing machine, as indicated by the wash classification code sent at the beginning of the wash cycle. Thus, the quantity of chemical to be dispensed, as well as the type of chemical to be dispensed in reaction to a particular feed request code can be a function of the wash classification code. For instance, a first feed request code might always represent a request for a particular chemical (e.g., bleach), but the quantity of the chemical represented by the feed request code might vary depending on the wash classification code. In another example, a second feed request code might represent a request for a first chemical for a first type of wash load (represented by a first wash classification code) and might represent a request for a second, different chemical, for a second type of wash load (represented by a second wash classification code).

Errors in classification dependent feed systems occur when the last wash classification code received by the chemical dispenser is no longer valid when a chemical feed request is received. For instance, if there has been a power outage of duration longer than N (e.g, 5) minutes, the last received wash classification code must be assumed to be invalid because a Cycle End code and Cycle Start/ID code might have been sent and missed by the dispenser during the power outage. Similarly, if a Cycle End code was received before a power outage, and after the power outage a feed request is received before a Cycle Start/ID code is received, the chemical dispenser must assume that it has missed the transmission of the Cycle Start/ID during the power outage. In either of these situations, the chemical dispenser's controller rejects the chemical feed request and logs it on the data log as being suspected of being erroneous.

In general, it is better to deliver no chemical to a washing machine than to deliver the wrong chemical. Rejecting a chemical feed request is generally accompanied the generation of an alarm signal that alerts plant personnel and allows them to intervene to remove the error condition.

In addition, the differences in washing machines types must be taken into account in determining which trigger signal sequences are errors. The two basic types of washing machines are microprocessor controlled machines and punched card or drum controlled machines (herein called chart controlled washing machines). The primary difference between these two types of machines is that a single chart in a chart machine can have more than one cycle start position. This allows the washing machine operator to wash different types of wash loads without changing the chart (i.e., card or drum), just by positioning the chart to one of several possible starting points before starting the washing machine. As a result, the chemical dispenser may receive two or more Cycle Start/ID codes from the washing machine without a Cycle End code between them. While this would be an error condition in a system using a microprocessor controlled washing machine, it is not an error condition in a system using a chart controlled washing machine.

Furthermore, the following rules are enforced by the control software in the chemical dispenser to prevent wrong chemical feeds.

Unless the washing machine is a chart controlled washing machine, receiving a Cycle Start/ID code without a Cycle End code having been received since the last received Feed Request is indicative of an error condition. To reduce the occurrences of this error condition, the first code transmitted by the washing machine during every washing cycle is preferably a Cycle End code, followed by a Cycle Start/ID code. To ensure that a cycle end is never missed unless the chemical dispenser's power is off for more that N (e.g., five) minutes, washing machines should be programmed so that every wash cycle is terminated by a Cycle End code, followed by another Cycle End code five minutes after the first Cycle End code.

If a chart controlled washing machine sends a Cycle Start/ID code, followed by zero or more feed request codes but no Cycle End codes, and then another Cycle Start/ID code, the chemical dispenser ignores the new wash classification code, records the event, and continues feeding chemicals based on the wash classification code received with the first Cycle Start/ID code.

If a microprocessor controlled washing machine sends a Cycle Start/ID code, followed by zero or more feed request codes but no Cycle End codes, and then another Cycle Start/ID code, the chemical dispenser accepts the new wash code classification, records the event, and processes subsequent feed requests based on the new wash classification code in the latest received Cycle Start/ID code.

Regardless of the type of washing machine being used, in systems using classification dependent feed arrangements, if a Cycle End code is followed by a chemical feed request code, with no Cycle Start/ID code between them, the chemical feed request is rejected, recorded, and an alarm signal is turned on to alert washroom personnel. All subsequent chemical feed requests are rejected until a Cycle Start/ID code is received.

Furthermore, in systems using classification dependent feed arrangements, whenever the chemical dispenser's controller detects that it has experienced a power outage of more than N (e.g., five) minutes, this means that the chemical dispenser may have missed a Cycle End and new Cycle Start/ID code. Therefore all chemical feed requests received by the chemical dispenser after a power outage of more than N minutes are rejected until a Cycle Start/ID code is received. The chemical feed request is recorded and an alarm signal is turned on to alert washroom personnel. Power outages of less than N minutes can be ignored.

Trigger Signal Handling Procedure

Figure 3:
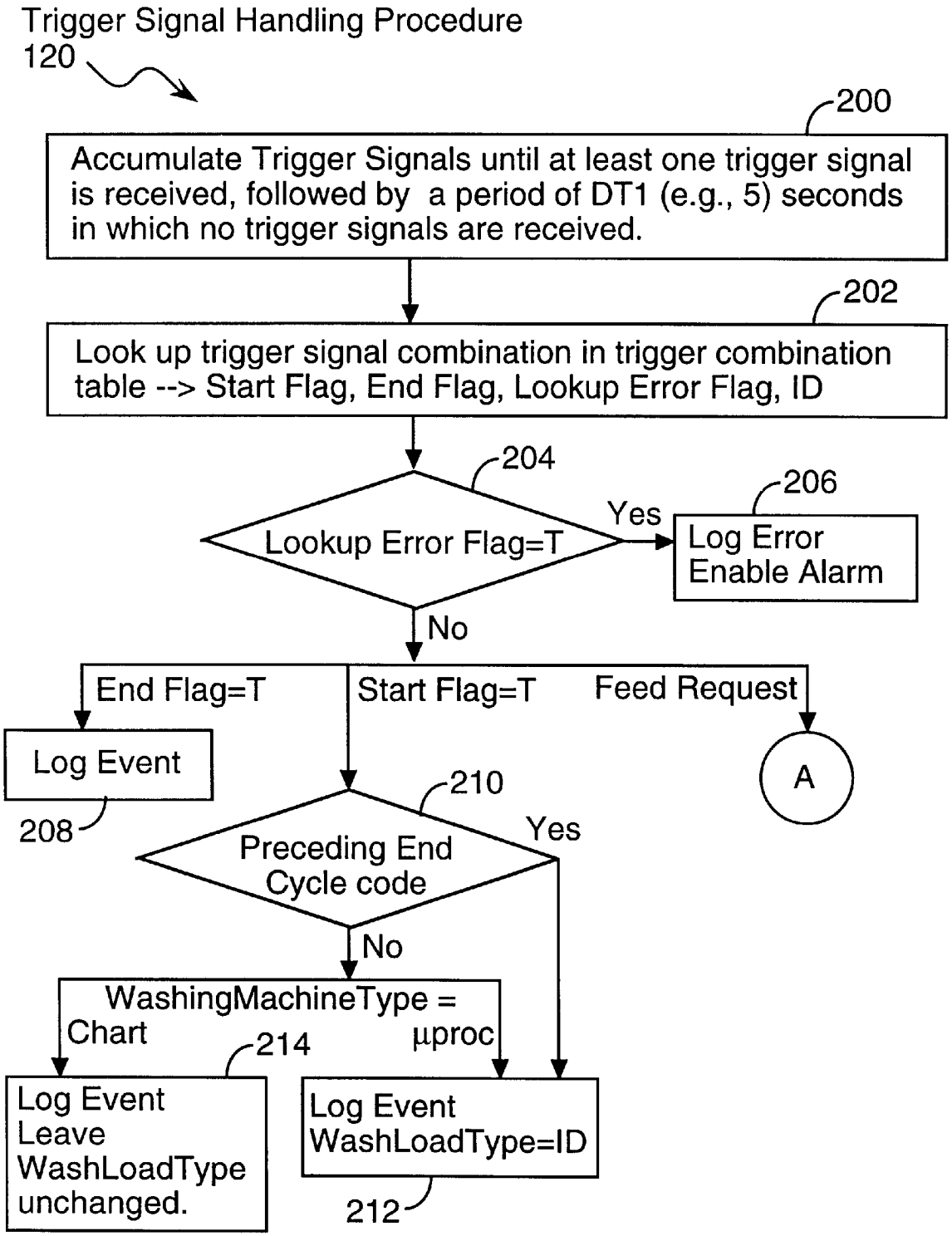
FIGS. 3 and 4 are a flow chart of a trigger signal handling procedure used in a preferred embodiment of the present invention.
Figure 4:
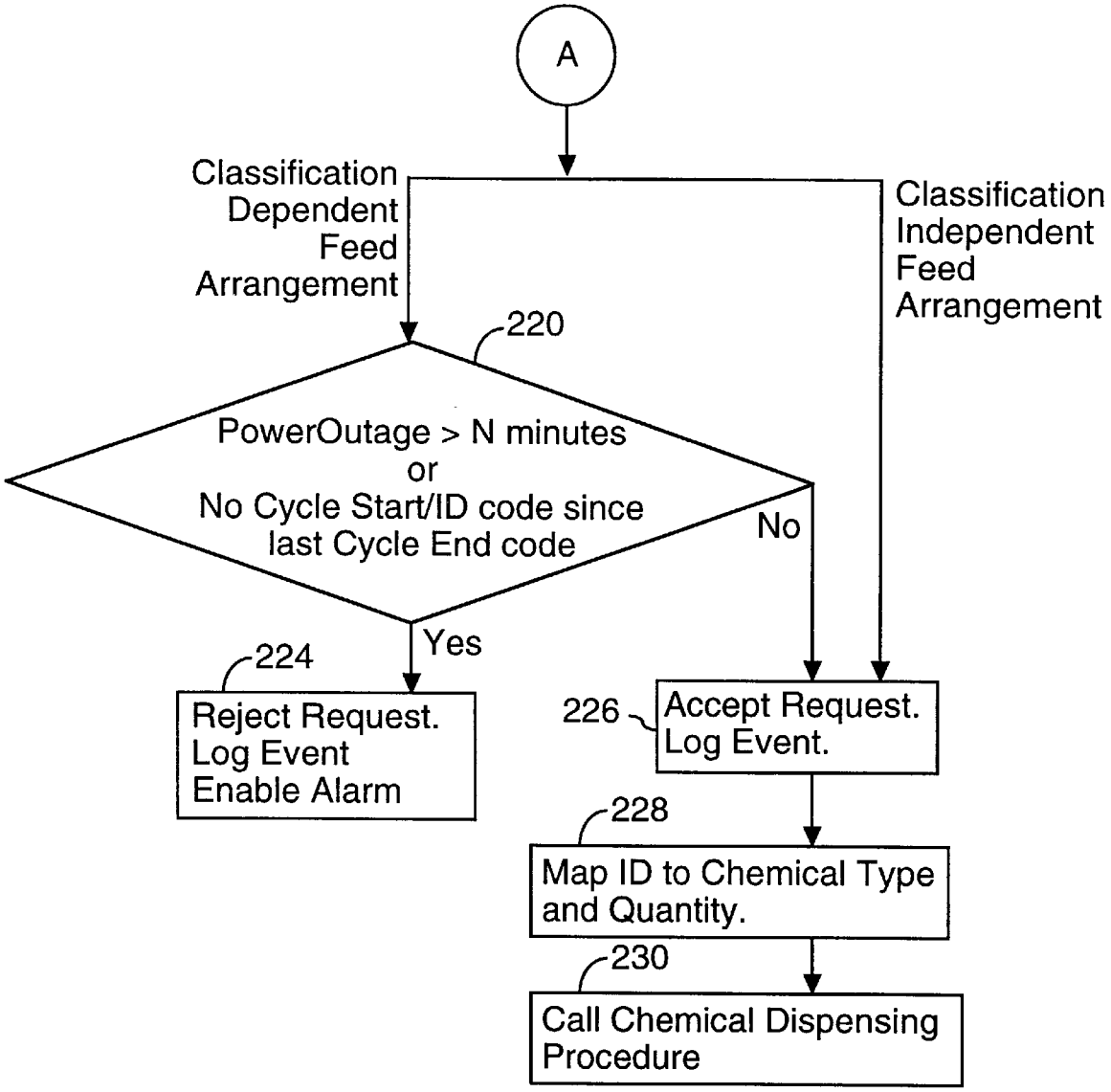

FIGS. 3 and 4 depicts a preferred embodiment of the trigger signal handling procedure 120. The procedure 120 is executed, once for each trigger signal combination received by the chemical dispenser. The procedure begins execution whenever a trigger signal is received, after not having received any trigger signals for at least DT1 (e.g., 5) seconds. The procedure then accumulates trigger signals until no trigger signals have been received for DT1 seconds (step 200). The procedure "accumulates" trigger signals by keeping a record of all the trigger signals received during the current signal accumulation time period.

In embodiments using simple trigger accumulation, the procedure keeps track of which signals have been received, but not the order in which they were received. This is typically accomplished by clearing a set of flags representing the set of possible trigger signals prior to the beginning of the accumulation time period, and then setting the flag corresponding to each trigger signal received during the accumulation time period.

In embodiments using time ordered trigger accumulation, the procedure keeps track of which signals have been received, as well as the order in which they were received. This is typically accomplished by clearing a vector of trigger signal values prior to the beginning of the accumulation time period, and then storing trigger signal values in successive positions of the vector for each trigger signal received during the accumulation time period.

Next, the accumulated trigger signals are mapped into a "code value" by looking up the accumulated trigger signals in the trigger signal look up table (step 202). The code value can include several components, including a start flag, an end flag, a lookup error flag, and a numerical ID value. The start flag is set only if the accumulated trigger signals represent a Start Cycle/ID code. The end flag is set only if the accumulated trigger signals represent an End Cycle code. The lookup error flag is set if the trigger signal lookup table does not contain an entry corresponding to the accumulated set of trigger signals. Finally, the ID value corresponds to the wash classification code or chemical feed code, if any, represented by the accumulated trigger signals. If the accumulated trigger signals do not have an ID value (e.g., because they represent an End Cycle code), the ID value is set to zero. Alternately, all possible sets of accumulated trigger signals may be mapped into a numerical value, where some numerical values are uniquely associated with Start Cycle/ID codes, others are uniquely associated with chemical feed requests, one is uniquely associated with the End Cycle code, and another is used to represent illegal sets of accumulated trigger signals.

If the accumulated trigger signal combination does not match any of the predefined legal trigger signal combinations (i.e., the received trigger signal combination does not match entries in the trigger combination table) (step 204), the received trigger signal combination is logged as an error, and an operator alarm is enabled so as to inform the laundry system operator that an error condition has occurred (step 206).

If the accumulated trigger signal combination indicates an End Cycle code, the event is logged (step 208). While no other "action" is taken on an End Cycle code, the receipt of at least one End Cycle code is important for correctly identifying the beginning of a next wash cycle.

If the accumulated trigger signal combination indicates a Start Cycle/ID code, the procedure first checks to see if the last code received before the current code was an End Cycle code (step 210). If the determination is positive (210-Yes), the event is logged, and the wash load type for the current wash load is set to the wash classification code indicated by the received trigger signal combination (step 212). Otherwise, if the last code received before the current code was not an End Cycle code (step 210-No), the procedure's response depends on the type of washing machine being serviced by the chemical dispenser. If the washing machine is a chart controlled machine, then the event is logged, but the wash load type is left unchanged (step 214). As explained above, in chart controlled washing machines it is possible for the machine to send out a Start Cycle/ID code in the middle of a wash cycle, and therefore such mid-cycle codes are preferably logged as a mid-cycle Start Cycle/ID code, but otherwise ignored by the chemical dispenser.

If the last code received before the current code was not an End Cycle code (step 210-No), and the washing machine is a microprocessor controlled machine, then the event is logged as an "Out of Sequence" Start Cycle/ID code, but the wash load type is nevertheless set to the wash classification code indicated by the received trigger signal combination (step 212). The receipt of the Start Cycle/ID code is most likely the result of either a power outage, or the result of a prior wash cycle being prematurely aborted for some reason. In either case, accepting the new wash classification code is important, especially in classification dependent feed arrangements.

If the accumulated trigger signal combination indicates a Feed Request code and a classification dependent feed arrangement is being used, the procedure (see FIG. 4) checks to see if either (A) there has been a power outage of greater than N minutes since the last Start Cycle/ID code was received by the chemical dispenser, or (B) if the chemical dispenser controller has not received a Start Cycle/ID code since the last End Cycle code it received (step 220). If either error condition is True (220-Yes), the feed request is rejected, the event is logged, and an operator alarm is enabled so as to inform the laundry system operator that an error condition has occurred (step 224). Further, if the chemical dispenser's user interface has an operator viewable display, appropriate operator instructions (e.g., to restart the current wash load) may be displayed. The feed request is rejected because the wash classification code for the wash load is unknown.

If there has not been a power outage longer than N minutes and the controller has received a Start Cycle/ID code since the last End Cycle code it received (220-No), the feed request is accepted and logged (step 226). The feed request code is then mapped by the procedure to a chemical type and quantity (step 228). In systems using a classification dependent feed arrangement, this mapping depends on the wash load type (i.e., the wash classification code) for the current wash load. Finally, the trigger signal handling procedure calls the chemical dispensing procedure (step 230), which activates the chemical feed pump 108 (FIG. 1) corresponding to the requested chemical for the amount of time required to dispense to proper quantity of that chemical.

If the accumulated trigger signal combination indicates a Feed Request code and a classification independent feed arrangement is being used, the feed request is accepted and logged (step 226), even if there has been a power outage longer than N minutes or the controller has not received a Start Cycle/ID code since the last End Cycle code it received, because honoring the feed request will not result in any improper chemicals being dispensed. The feed request code is then mapped by the procedure to a chemical type and quantity (step 228). In systems using a classification independent feed arrangement, this mapping is the same for all wash load types. Finally, the trigger signal handling procedure calls the chemical dispensing procedure (step 230), which activates the chemical feed pump 108 (FIG. 1) corresponding to the requested chemical for the amount of time required to dispense to proper quantity of that chemical.

ALTERNATE EMBODIMENTS

For systems where the washing machine has four or fewer trigger signals, but more than fifteen wash classification codes are needed, an alternate embodiment of present invention can be used. In this alternate embodiment, trigger signals are accumulated with respect to their time order, and furthermore each trigger signal can be used multiple times during a single trigger sequence. For instance, in a system having four trigger signals T4, T3, T2 and T1, with T4 being reserved for indicating the start and end of wash cycles, legal trigger signal sequences for indicating a Start Cycle/ID code would include:

| |
|---|
| T4 T3 T2 T1 T2 T3 |
| T4 T1 T2 T1 T2 T1 |

and so on. By allowing individual trigger signals be used more than once in each Start Cycle/ID code and in each Feed Request code, the number of wash classification codes and feed request codes becomes virtually infinite. In this alternate embodiment the trigger pattern table is expanded to include all defined (legal) trigger signal sequences, including those that use individual trigger signals more than once. In all other respects, the operation of the present invention remains unchanged.

While the present invention has been described with reference to a few specific embodiments, the description is illustrative of the invention and is not to be construed as limiting the invention. Various modifications may occur to those skilled in the art without departing from the true spirit and scope of the invention as defined by the appended claims.

What is claimed is:

1. A control system for use in conjunction with a mechanism for dispensing chemicals from a set of chemical supplies and a device that transmits trigger signals to the control system for requesting chemicals to be dispensed from the chemical supplies, the control system comprising:

trigger signal accumulating means for accumulating sequences of trigger signals received by the control system, each trigger signal sequence consisting of one or more received trigger signals, each trigger signal sequence being preceded and followed by a period of time of predefined duration during which no trigger signals are received; wherein a non-zero subset of the trigger signal sequences received each includes two or more trigger signals, and wherein at least some of the trigger signals in some of the trigger signal sequences are not received simultaneously;

trigger signal sequence mapping means for mapping at least a subset of the accumulated sequence of trigger signals received by the control system into corresponding control codes;

dispensing control means for controlling the dispensing of chemicals from the chemical supplies in accordance with the control codes.

2. The control system of claim 1, wherein:

the trigger signal sequence mapping means maps at least a first non-zero subset of the accumulated trigger signal sequences into chemical feed requests, each chemical feed request comprising a request for dispensing a quantity of chemical from a corresponding one of the chemical supplies; and the dispensing control means controls the dispensing of chemicals from the chemical supplies in accordance with the chemical feed requests.

3. The control system of claim 2, wherein:

the trigger signal sequence mapping means maps a second non-zero subset of the accumulated trigger signal sequences into wash classification codes, each wash classification code identifying a type of wash load to be washed using the dispensed chemicals;

the device that transmits trigger signals can transmit at most T distinct trigger signals, the wash classification codes requests to which accumulated trigger signal sequences are mapped by the mapping means include at least W distinct wash classification codes, and W is larger than T; and the control system including data logging means for logging the wash classification codes and chemical feed requests.

4. The control system of claim 3, wherein the trigger signal sequence mapping means maps the first subset of accumulated trigger signal sequences into chemical feed requests in accordance with an earlier received trigger signal sequence that was mapped into a wash classification code, such that at least one predefined trigger signal sequence is mapped into a first chemical feed request for a first wash load type and is mapped into a distinct, second chemical feed request for a second wash load type.

5. The control system of claim 3, wherein the trigger signal sequence mapping means maps at least one predefined accumulated trigger signal sequence into a wash cycle end code; and the trigger signal sequence mapping means includes means for rejecting an accumulated trigger signal sequence in the second subset when the accumulated trigger signals sequence in the second subset has not been preceded by one of the at least one predefined accumulated trigger signal sequences that are mapped into a wash cycle end code.

6. The control system of claim 3, wherein the control system includes power outage detection means for detecting control system power outages and for determining duration of such control system power outages; and the trigger signal sequence mapping means includes means for rejecting an accumulated trigger signal sequence in the first subset when (A) the power outage detection means has detected a power outage whose duration exceeded a predefined threshold, and (B) a trigger signal sequence in the second subset has not been received since a last time the power outage detection means detected a power outage whose duration exceeded the predefined threshold.

7. The control system of claim 2, wherein the device that transmits trigger signals can transmit at most T distinct trigger signals, the chemical feed requests to which accumulated trigger signal sequences are mapped by the mapping means include at least R distinct chemical feed requests, and R is larger than T.

8. The control system of claim 1, wherein:

the trigger signal sequence mapping means maps a non-zero subset of the accumulated trigger signal sequences into wash classification codes, each wash classification code identifying a type of wash load to be washed using the dispensed chemicals;

the device that transmits trigger signals can transmit at most T distinct trigger signals, the wash classification codes requests to which accumulated trigger signal sequences are mapped by the mapping means include at least W distinct wash classification codes, and W is larger than T; and the control system including data logging means for logging the wash classification codes and chemical feed requests.

9. A method of controlling chemical dispensing, for use in conjunction with a mechanism for dispensing chemicals from a set of chemical supplies, and a device that transmits trigger signals to the control system for requesting chemicals to be dispensed from the chemical supplies, the control system comprising:

receiving and accumulating sequences of the transmitted trigger signals, each trigger signal sequence consisting of one or more trigger signals, each trigger signal sequence being preceded and followed by a period of time of predefined duration during which no trigger signals are received; wherein a non-zero subset of the trigger signal sequences received each includes two or more trigger signals, and wherein at least some of the trigger signals in some of the trigger signal sequences are not received simultaneously;

mapping at least a subset of the accumulated sequence of trigger signals received by the control system into corresponding control codes; and controlling the dispensing of chemicals from the chemical supplies in accordance with the control codes.

10. The control method of claim 9, wherein:

the mapping step maps at least a first non-zero subset of the accumulated trigger signal sequences into chemical feed requests, each chemical feed request comprising a request for dispensing a quantity of the chemical from a corresponding one of the chemical supplies; and controlling the dispensing of chemicals from the chemical supplies in accordance with the chemical feed requests.

11. The control method of claim 10, wherein:

the mapping step maps a second non-zero subset of the accumulated trigger signal sequences into wash classification codes, each wash classification code identifying a type of wash load to be washed using the dispensed chemicals;

the device that transmits trigger signals can transmit at most T distinct trigger signals, the wash classification codes requests to which accumulated trigger signal sequences are mapped include at least W distinct wash classification codes, and W is larger than T; and the method includes logging the wash classification codes and chemical feed requests.

12. The control method of claim 11, wherein the mapping step maps the first subset of accumulated trigger signal sequences into chemical feed requests in accordance with an earlier received trigger signal sequence that was mapped into a wash classification code, such that at least one predefined trigger signal sequence is mapped into a first chemical feed request for a first wash load type and is mapped into a distinct, second chemical feed request for a second wash load type.

13. The control method of claim 11, wherein the mapping step maps at least one predefined accumulated trigger signal sequence into a wash cycle end code; and the mapping step rejects an accumulated trigger signal sequence in the second subset when the accumulated trigger signals sequence in the second subset has not been preceded by one of the at least one predefined accumulated trigger signal sequences that are mapped into a wash cycle end code.

14. The control method of claim 11, wherein the method includes detecting control system power outages and determining duration of such control system power outages; and the mapping step includes rejecting an accumulated trigger signal sequence in the first subset when (A) the power outage whose duration exceeds a predefined threshold has been detected, and (B) a trigger signal sequence in the second subset has not been received since a last time that a power outage was detected whose duration exceeded the predefined threshold.

15. The control method of claim 10, wherein the device that transmits trigger signals can transmit at most T distinct trigger signals, the chemical feed requests to which accumulated trigger signal sequences are mapped by the mapping means include at least R distinct chemical feed requests, and R is larger than T.

16. The control method of claim 9, wherein:

the mapping step maps a non-zero subset of the accumulated trigger signal sequences into wash classification codes, each wash classification code identifying a type of wash load to be washed using the dispensed chemicals;

the device that transmits trigger signals can transmit at most T distinct trigger signals, the wash classification codes requests to which accumulated trigger signal sequences are mapped include at least W distinct wash classification codes, and W is larger than T; and the method includes logging the wash classification codes and chemical feed requests.

* * * * *